US007716795B2

(12) United States Patent
Versellie et al.

(10) Patent No.: US 7,716,795 B2
(45) Date of Patent: May 18, 2010

(54) ANTI-RATTLE TONGUE PLATE ASSEMBLY

(75) Inventors: Jeffrey T. Versellie, Davison, MI (US); Mark L. Wilsey, Howell, MI (US)

(73) Assignee: TK Holdings Inc., Auburn Hills, MI (US)

( * ) Notice: Subject to any disclaimer, the term of this patent is extended or adjusted under 35 U.S.C. 154(b) by 647 days.

(21) Appl. No.: 11/517,292

(22) Filed: Sep. 8, 2006

(65) Prior Publication Data

US 2007/0050953 A1 Mar. 8, 2007

Related U.S. Application Data

(60) Provisional application No. 60/715,032, filed on Sep. 8, 2005.

(51) Int. Cl.
*A44B 11/00* (2006.01)

(52) U.S. Cl. ..... 24/593.1; 24/633; 24/DIG. 51; 280/801.1

(58) Field of Classification Search ..... None
See application file for complete search history.

(56) References Cited

U.S. PATENT DOCUMENTS

| | | | | |
|---|---|---|---|---|
| 4,480,854 | A | 11/1984 | Doty | |
| 4,588,207 | A | 5/1986 | Doty | |
| 4,901,407 | A * | 2/1990 | Pandola et al. | 24/633 |
| 4,903,377 | A * | 2/1990 | Doty | 24/194 |
| 6,837,519 | B2 | 1/2005 | Moskalik et al. | |

* cited by examiner

*Primary Examiner*—Jack W. Lavinder
(74) *Attorney, Agent, or Firm*—Foley & Lardner LLP

(57) ABSTRACT

An anti-rattle tongue plate assembly for a seat belt and the method of making the same are provided with a cover member of a hard material that is a distinct component and has soft material on the cover member to reduce noise. The cover member may be a cinch member slidably mounted on the tongue plate. The soft material may be mechanically joined and bonded to the hard material of the cinch member.

17 Claims, 4 Drawing Sheets

FIG. 4
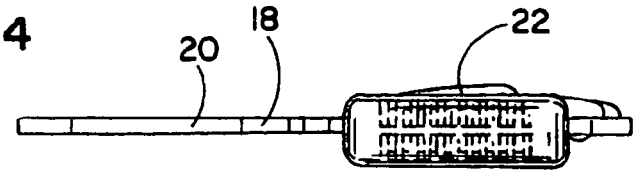
FIG. 5
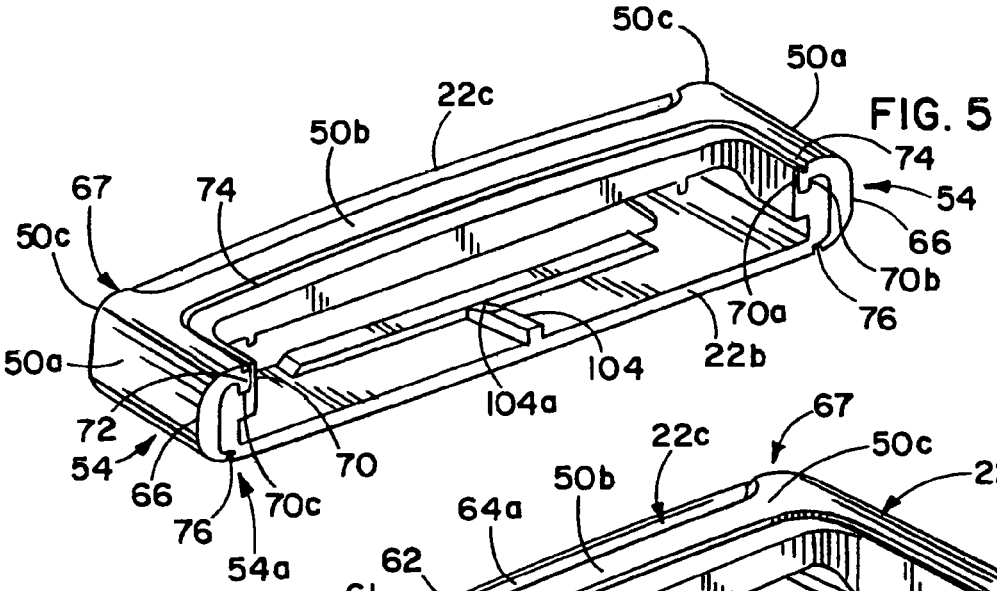
FIG. 6
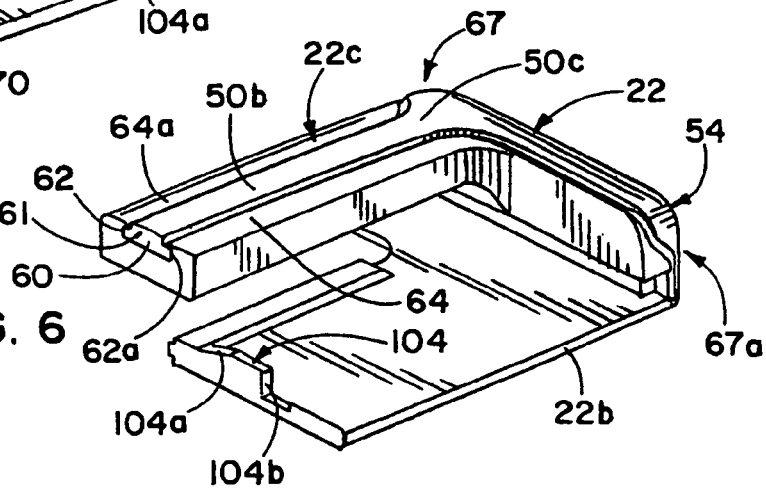
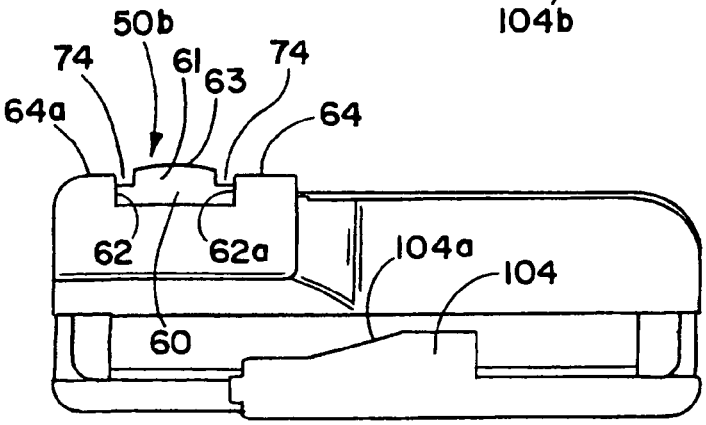
FIG. 7

ANTI-RATTLE TONGUE PLATE ASSEMBLY

CROSS REFERENCE TO RELATED APPLICATION

This application claims priority to and the benefit of U.S. Provisional Patent Application Ser. No. 60/715,032 filed on Sep. 8, 2005.

BACKGROUND

The invention relates to a tongue plate assembly for a seat belt system and, more particularly to a tongue plate assembly having an anti-rattle construction and a method for making the same.

Tongue plate assemblies that latch into buckles for securing a seat belt about an occupant of a vehicle seat are usually made from a stamped-metal tongue plate in which the tongue plate has a hard plastic insert located at an elongated, laterally extending opening in a wide portion of a plate body for the seat belt webbing. In many seat belts systems, the tongue plate assembly typically is positioned between the side trim of the vehicle and the outboard side of the vehicle seat when in the unlatched or stowed condition. In some recent model vehicles, there has been a gradual reduction in the amount of space between the side of the vehicle seat and the side trim of the vehicle interior. In some instances, the seat belt twists and positions an edge of the tongue plate assembly to engage a pillar or side rim in the vehicle. Accordingly, when the vehicle is undergoing rough ride conditions, the tongue plate assembly is more likely to shake and vibrate on the belt webbing and engage against the hard side trim panel in the vehicle interior generating undesirable noise in the vehicle compartment.

U.S. Pat. No. 6,837,519 (incorporated by reference herein) is directed to a non-cinching tongue plate assembly having a latch plate with a coating of hard plastic material over molded onto the plate. In a cinch tongue plate assembly, a slidable cinch member or portion is a distinct, discrete member which is slidably mounted for movement relative to the tongue plate body to cinch or grip the belt passing through the assembly such as described in U.S. Pat. Nos. 4,480,854 and 4,588,207 (both incorporated by reference herein). As described in the latter patent, a slidable cinch member is free falling along the belt until the seat belt is latched; and after latching, the cinch portion grips the belt to limit free transfer between the shoulder belt portion and the lap portion. In a typical cinch-type tongue plate assembly, the slidable cinch member has top and bottom sides extending over the top and bottom sides of the tongue plate and has outer side edge portions wrapped about the outer side edges of the tongue plate. Thus, there is a need for providing noise reducing material on the cinch member, and particularly the side edges thereof which are projecting laterally outwardly relative to the tongue plate body.

The non-cinch, tongue plate assembly of the '519 patent lacks a slidable clinch member slidably mounted on the tongue plate body. In the '519 patent, it is stated that while the hard plastic is being molded onto the tongue plate and is still warm, a soft plastic over molded onto the warm, hard plastic material on the plate. While providing noise reduction, over molding two coatings of plastic material onto the latch plate assembly undesirably increases the manufacturing costs for the latch plate. In this regard, two insert molds need to be employed into which the operator has to manually load the part onto which the over mold is to be applied. So in the latch plate assembly disclosed by the '519 patent, there is a first insert mold in which the operator places the plate body for having the hard plastic over molded thereon. Thereafter, with the hard plastic still warm, the operator removes the plate body with the warm over mold of hard plastic, and places it in the next insert mold. This insert mold is then cycled for over molding the soft plastic material onto the warm, hard plastic material. As is apparent, the two insert molds require significant operator intervention for generating the over molded latch plate assembly of the '519 patent.

Accordingly, there is a need for an anti-rattle, tongue plate assembly having a distinct, discrete cover member, particularly for a cinch type of tongue assembly having a slidable cinch member on a tongue plate body and having an anti-rattle construction. The tongue plate assembly with the distinct, discrete cover member may improve the manufacturing cost efficiencies for the anti-rattle construction.

SUMMARY

In accordance with a disclosed embodiment, an anti-rattle tongue plate assembly is provided that may include a cover member which is a component distinct from the plate body and which has a soft material at predetermined locations on the cover body to reduce noise. That is, the softer material on the distinct cover member endeavors to minimize noise when the tongue plate assembly engages against interior components of the vehicle such as during rough ride conditions. The cover member may be made into a distinct component to be operably connected to the tongue plate body.

The cover member may be a seat belt cinching member of hard material, such as a hard plastic, having soft plastic or other anti-rattling material thereon to reduce noise. The cinching cover member may be slidably mounted on the tongue plate and may be provided with soft material at predetermined locations to reduce noise due to the impacts with portions of the vehicle.

In one of the embodiments illustrated herein, the slidable cinch member extends about all four sides of the tongue plate and the outer side edges of the slidable member are provided with the anti-rattle material. The rear side of the slidable cinch member may also be provided with an anti-rattle, soft material. The anti-rattle material may be a continuous piece of soft molded plastic having a central strip extending across the rear side of the cinch member and having end portions which are joined at opposite ends of the strip and which extend laterally along the respective side edges of the cinch member. The soft material may substantially cover the entire lateral side of the cinch member. In one embodiment, the soft material may also be extended to cover the four corners of the slidable, cinch member.

In accordance with an embodiment, an anti-rattle cinch tongue plate assembly is provided, which has a cinch cover plate or member which is slidably mounted on the plate body and has a slot through which the seat belt passes. The cinch cover member may be cinched against the plate body and may be provided with a soft material that is bonded and mechanically joined to the cover member. In an embodiment, the cover member may be a hard material, such as a first plastic, and the soft material may be another plastic material which is over molded onto the hard material and may have interfacing portions mechanically retaining the soft material on the cover member. The outer edge of the cinchable cover member may be provided with a mechanical groove in which a soft cover member is positioned for reducing the noise when the cover member comes into engagement with a hard plastic material side trim of the vehicle.

BRIEF DESCRIPTION OF THE DRAWINGS

The features, aspects, and advantages of the present invention will become apparent from the following description, appended claims, and the accompanying exemplary embodiments shown in the drawings, which are briefly described below.

FIG. 4 is a side elevational view of the cinch tongue plate assembly shown in FIG. 1.

FIG. 5 is an enlarged, perspective view of the cover member showing a hard cinch member having a soft material mounted thereon and which is both bonded and mechanically joined to the hard cinch member.

FIGS. 6 and 7 are partially broken away views of the cinch cover member shown in FIG. 5.

DETAILED DESCRIPTION

Figure 1:
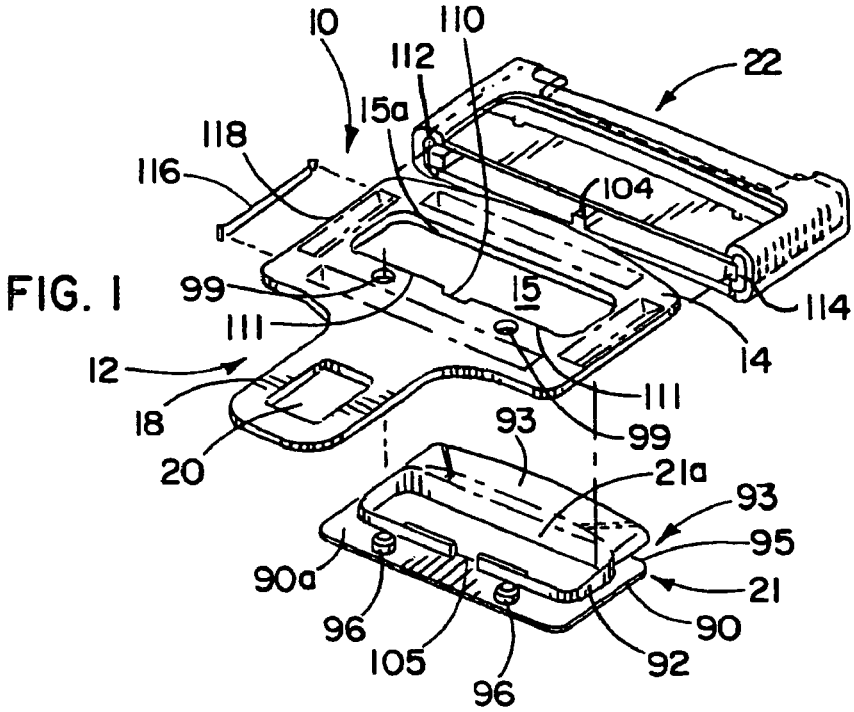
FIG. 1 is an exploded view of a tongue plate assembly showing a cover member such as a moveable cinch member having soft material portions thereon for noise reduction.
Figure 2:
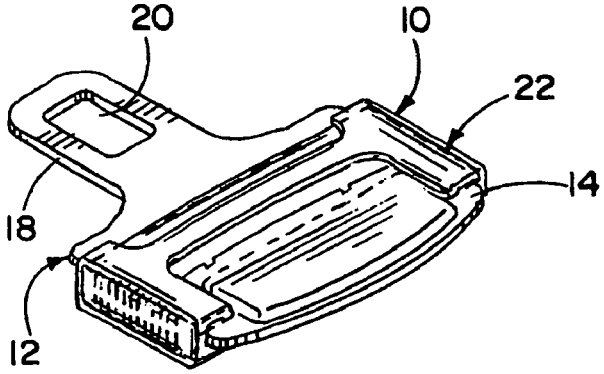
FIG. 2 is a perspective view of the tongue plate assembly shown in FIG. 1.
Figure 3:
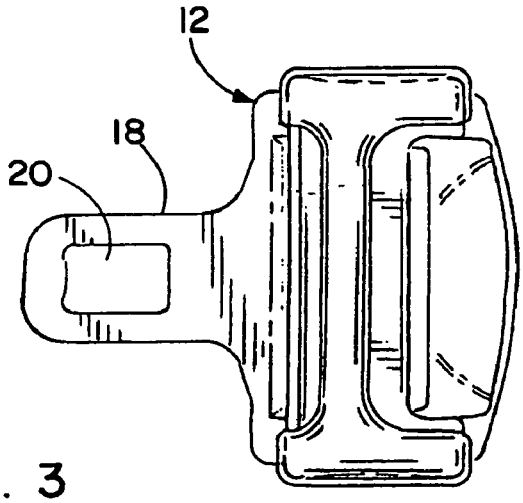
FIG. 3 is a plan view of the cinch tongue plate assembly shown in FIG. 1.

A tongue plate assembly 10 is shown in the drawings. The tongue plate assembly 10 may have a tongue plate body 12 which is usually formed of a piece of hard metal and which is formed with a wide portion 14 having a slot 15 for receiving a seat belt 16 which passes through the slot. The plate body 12 may also be provided with a narrow latching portion 18 formed with the slot or opening 20 for being latched to a buckle 32. A hard plastic cover member 22, which is a distinct component from the plate or tongue body 12, is made of a hard material such as plastic material and is mounted on the wide portion 14 of the plate body 12. The hard material for the cinch cover member is usually a plastic material, such as nylon or acetyl material.

Figure 9:
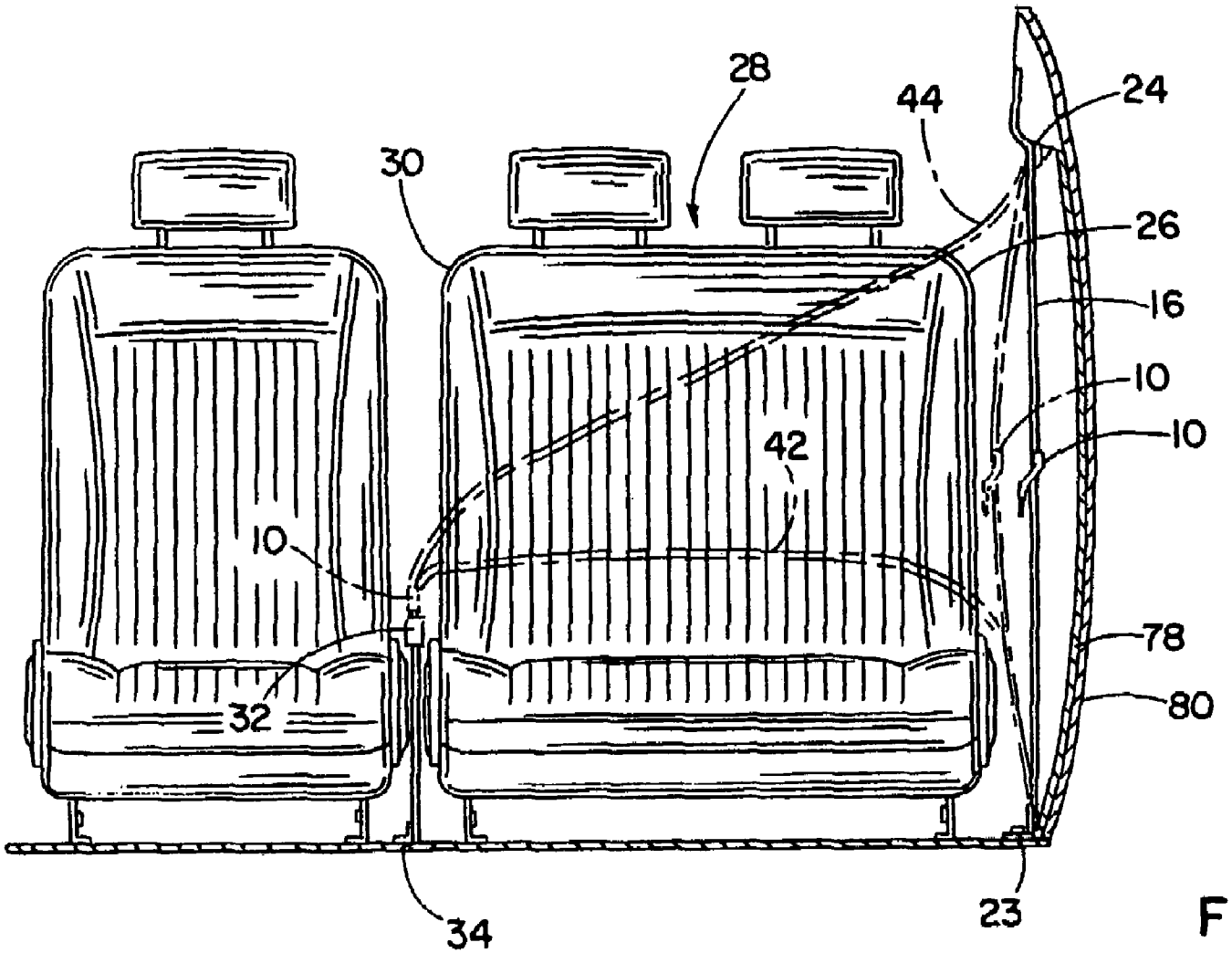
FIG. 9 is an elevational view of a passenger compartment of a vehicle showing an example of a seat belt system which uses the tongue plate assembly.

The cover member 22 may also be a cinch member that is slidably mounted on the plate body 12 in such a manner that the entire tongue plate assembly 10 is free-falling in the sense that it may be pulled and slid downwardly by the user when buckling up in a three point suspension as shown in FIG. 9. The tongue plate assembly 10 freely slides along the belt webbing 16 until stopped at a stop (not shown) on the webbing to position the tongue plate in an elevated stowed position as best seen in FIG. 9. In this three point system, there is a lower anchor 23 for the belt webbing and an upper anchor 24 which may include a guide loop for redirecting the seat belt from the retractor down towards the lower anchor 23. These anchors 23 and 24 are generally positioned along an outboard side 26 of a vehicle seat 28 with which the seat belt carrying the tongue plate assembly 10 is to be used. At the inboard side 30 of the seat, a buckle 32 is anchored at the location 34 of the vehicle and is configured for receiving and releasably locking the tongue plate assembly 10 in a conventional manner. Manifestly, the tongue plate may be of various shapes and used with a wide variety of anchoring arrangements which may differ from those shown in FIG. 9. The tongue plate is particularly useful where the webbing tends to twist the tongue plate assembly 10 so that an edge thereof is positioned in its stowed position so as to engage a piece of the side trim of the vehicle against which it may contact and to make noise particularly when traveling over rough road conditions. Thus, there is a need for cushioning the material that is associated with the tongue plate assembly 10 so as to reduce the noise.

In order to engage the tongue assembly 10 in a locking engagement with the seat belt buckle 32, the occupant of the seat grasps the tongue assembly 10 and pulls the assembly 10 downwardly in a lateral direction across the shoulder and lap of the occupant until the tongue is brought into a latching engagement with the buckle 32. During this downward pull, sufficient webbing 16 is pulled out to define the lap engaging band or portion 42 and a shoulder engaging band or portion 44 about the occupant. The user may grasp the sides 54 of the cover member 22 when pulling the seat belt downwardly to buckle up, and the webbing 16 freely slides past the cinch cover member 22 which is in a non-cinching position during this bucking operation. When the tongue plate assembly 10 engages with the buckle 32, the pull of the retractor (not shown) exerts an upwards force on the shoulder belt 44 pulling the cover member 22 upwardly and outwardly toward the turning loop. Thus, the cover member 22 is carried such that the cinching surface 22*a* on the cinch cover member 22 engages and pushes the belt into a snubbing engagement with a liner surface 21*a* on the stationary liner 21 on the stationary tongue plate 12. More specifically, the shoulder belt portion 44 comes across the top side of the tongue plate assembly 10 across the upper side of the liner 21, past the cinching surface 22*a* on the cinch bar or member 22*b* and through the slot 15 in the tongue plate body 12, and across a lower pull bar 22*c* on the cinch cover member 22 to the lap belt portion 42. The upward and outboard pull on the lower pull bar 22*c* of the cinch cover member 22 by the shoulder belt portion 44 forces the cinch surface 22*a* on the top plate 22*b* of the cinch cover member 22 to also slide upwardly to cinch and push the top side of the belt and force the lower side of the belt against the cinching surface 21*a* on the liner 21. Thus, the pull of the upper shoulder belt slides the cover member 22 to slide along the plate body 12 into the snubbing position and to shift the cinching surface 22*a* towards the fixed, stationary cinching surface 21*a* on the liner 21 so that the belt is cinched or gripped between the cinching surface 22*a* and 21*a*. In this cinching position, the belt is gripped so that there is less likelihood of a belt transfer between the shoulder portion and the lap portion when the buckle is engaged and cinched. This arrangement is in contrast to the tongue plate disclosed in U.S. Pat. No. 6,837,519 where there is no slidable cinch member and no cinching of the belt.

In one embodiment, the tongue plate assembly 10 is formed to be of an anti-rattle construction by having the cover member 22 being formed of a hard material, which is a discrete or distinct slidable component which shifts relative to the tongue plate body 12. The cover member 22 may have softer material 50 at predetermined locations on the slidable cover member 22 to reduce noise due to impacts with portions of the vehicle body.

The cinch cover member 22 may include at least one locking groove, and the soft material is over molded on the cover member 22 and into the locking groove for binding and mechanically retaining the soft material on the cover member. The cover member 22 may have soft material covering the lateral sides 54 of the cover member 22, as seen in FIG. 5, to provide noise cushions for the side edges of the tongue plate assembly 10, particularly if the belt becomes twisted and these side edges are shifted due to the vibrations caused by movements of the tongue assembly 10 relative to the vehicle due to impacts on the vehicle.

In the embodiment shown in FIG. 5, the cover member 22 has its lower pull bar 22*c*, which extends laterally across the underside of the cover member, with soft material 50 thereon as does the side edges 54 of the slidable cover member. The corners of the cover member may also have soft material thereon for anti-rattling purposes.

In the method of forming the anti-rattle tongue plate assembly, the tongue plate body 12 is formed and the hard insert liner 21 is attached thereto. The cover cinch member 22 that slides on the tongue plate body 12 is formed as a distinct plastic molded part of hard material and the soft material 50 is molded and mechanically secured to the slidable cinch cover member 22 which is then mounted onto the tongue plate body 12 with the cover member 22 in which the soft material 50 may be positioned to prevent rattling when the assembly is installed in the vehicle. In this embodiment, the cover member 22 may be formed by molding the hard plastic material and then the cover member 22 is placed in an insert mold and the soft material 50 is over molded onto the molded cover member 22. Thereafter, the slidable cinch cover member 22 with the soft material 50 thereon is assembled onto the tongue plate body 12 to complete the tongue plate assembly.

The soft member 50 may include a center strip 50*b* on the exterior side lower pull bar 22*c* which extends across the underside of the cinch cover member 22 and which faces outwardly for engagement with the vehicle side trim or the like. This center strip 50*b* may be provided to reduce noise because the soft material 50 may engage the side trim of the vehicle rather than the hard material. The side strips or areas 50*a* of the soft material may be joined integrally at and to the opposite ends of the central strip 50*b* of the soft material and are adapted to substantially encompass the entire hard material side edges 54 of the slidable cinch cover member 22. This arrangement provides a soft material surface for the cinch cover member 22 such that the side edges substantially dampen noise if the buckle becomes twisted and if the side edges are brought into engagement with the trim. The corners of the slidable cinch cover member 22 may also be provided with soft material 50*c* for noise reduction.

The soft material 50 may be interlocked by a mechanical locking groove with the hard material of the cinch cover member 22. For this purpose, the cross-section through the central strip 50*b* of the soft material, as shown in FIGS. 6 and 7, is provided with a lower, rectangular bar-shaped portion 60 with an upwardly narrower central portion 61 projecting above the lower rectangular portion 60. The lower rectangular portion 60 is wider than the upper portion 61 and extends between side edges 62 and 62*a* that form a channel in the hard material extended across the entire width of the pull bar 22*c* of the cinch cover member 22. The upper projecting portion 61 may have a rounded or arcuately curved surface 63 which extends above the respective hard material top side surfaces 64 and 64*a* of the pull bar 22*c*. Thus, the rounded surface 63 may be positioned and elevated so as to engage the side trims and prevent rattling rather than having the hard surfaces 64 and 64*a* of the pull bar 22*c* being engaged with the side trims and rattling.

Figure 8:
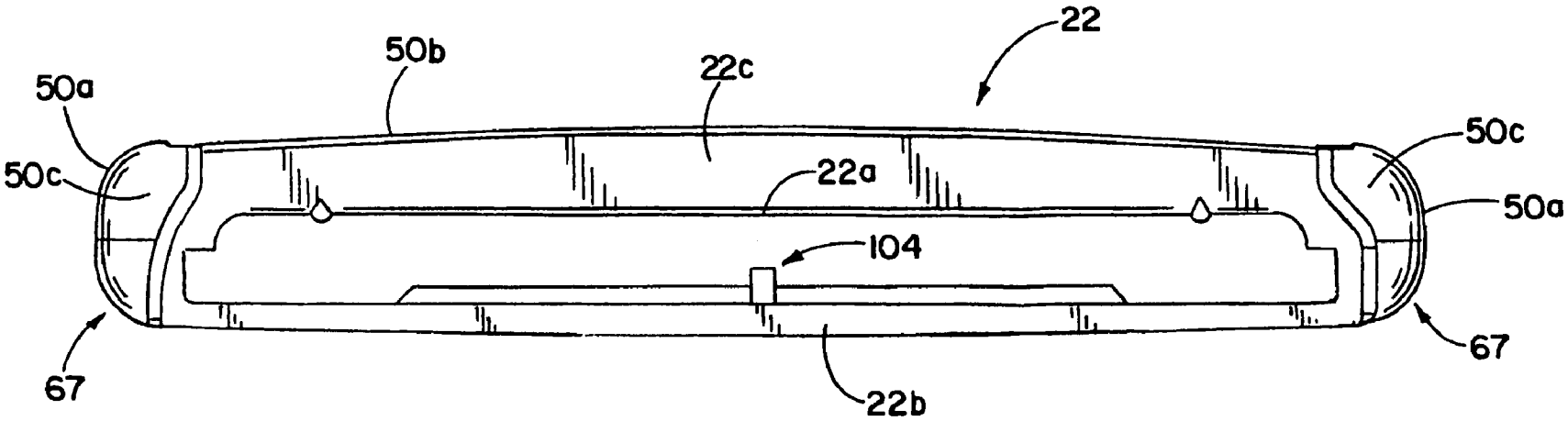
FIG. 8 is a side elevational view of the cinch member shown in FIG. 5.

The mechanical interlock may be provided between the soft material 50 and the hard material at the sides 54 of the cinch cover member 22 as may be best be understood from FIG. 5. The soft material 50*a* is wrapped completely around and covers substantially all of the side 54 of the hard plastic cinch cover member 22 and is provided with an outer rounded surface 66, which is positioned to engage the side trim of the vehicle to provide noise protection. The rounded ends or corner portions 50*c* of the soft material may be located at the corners 67 as seen in FIGS. 5, 6, and 8 so that the corners 67 of the soft material are also positioned to engage any side trim to prevent rattling.

Turning now to the interlock construction shown in FIG. 5 between the side of soft material 50*a* and the hard material sides 54 for the cinch cover member 22, the hard material is formed with an interlock groove 70 which extends downwardly between an inner, longer vertical side wall 70*a* and an outer side wall 70*b* and with a lower bottom wall 70*c*. Soft material fills the groove 70 and extends upwardly with a projection 72 of the soft material being positioned in the interlock groove 70 and abutting the respective groove walls 70*a*, 70*b*, and 70*c* with the soft material being over molded therein. An encircling groove or slot 74 may be extended about the entire inner portion of the portion 72 of the soft material, as best seen in FIGS. 5 and 6, and across the center strip 50*b* (FIG. 7). An outer rounded surface 66 of the soft material extends around a similar rounded internal portion of the sidewall position 54 of the hard material of the cinch cover member 22. There may be provided a bottom lip 76 on the soft material which is positioned and engaged with the bottom side of the lateral side edge 54*a* of the hard material for the cinch cover member ends 54. The projection 72 of the soft material and the bottom lip 76 are also positioned offset in a lateral direction relative to one another and provide a good mechanical grip or interlock with the sides of the hard plastic member. Manifestly, other interlocking configurations or other ways of attaching the soft material 50 to the slidable cinch cover member 22 may be used and may be considered further embodiments.

As best seen in FIG. 6, the soft material 50 may only cover the forward corners 67, but also may extend rearwardly across the entire side edge of the cinch cover member 22 back to a rear or lower corner 67*a*, as shown in FIG. 6, and may be mechanically interlocked therewith as shown in some of the other views. Thus, the entire sides of the cover member 22 may be covered with the soft material 50. The soft material 50 on the side edges also may provide a good gripping surface for the user to grasp the slidable cinch cover member 22 and to pull the assembly 10 downwardly when pulling the entire tongue plate assembly 10 down toward the opposite hip to latch the tongue plate assembly 10 to the buckle assembly as best understood from FIG. 9. The downward movement, of course, moves the respective snubbing or cinching surfaces 21*a* and 22*a* away from one another within the tongue plate assembly 10 so that the assembly slides quite freely on the belt 16 until the buckle 32 and tongue plate assembly 10 are latched together whereupon the user releases the grip on the slidable cinch cover member 22 and the retractor spring acting on the shoulder belt pulls the lower cinch bar 22*c* upwardly to move the entire slidable cinch cover member 22 upwardly causing the cinch surface 22*a* on the cinch bar or plate 22*b* to push the belt against the other cinching surface 21*a* on the liner 21 which engages the rear or the opposite side of the seat belt. Thus, there is less tendency of the seat belt to slide between the lap portion 42 and the shoulder portion 44 because of this cinching engagement.

Referring now in greater detail to the liner 21 which is shown in FIG. 1, the liner 21 may be an integral hard molded piece of plastic which may be molded as a separate, distinct piece or component and then assembled onto the tongue plate and interlocked thereon, as will be explained hereinafter. The liner 21 may have a flat panel 90 extending along one side of the tongue plate body 12 and on this flat panel 90 there is an upwardly projecting, thin rim 92 that is sized and spaced to fit upwardly in the tongue plate opening 15. The rim 92 may extend about substantially the entire periphery of the belt receiving slot 15 in the tongue plate body 12. The liner 21 may be a thickened rear portion 93 which extends parallel to and defines a channel 95 with the lower panel 90 in which an upper side wall 15*a* of the slot 15 in the metal tongue plate body 12 will be inserted. For the purpose of interlocking the molded liner 21 with the tongue plate body 12, the liner 21 is provided with a pair of upwardly hollow, cylindrical projections or nibs 96 in the front lip 90*a* of the panel 90 for insertion into a pair of holes 99 located in the metal tongue plate body 12 as shown in FIG. 1.

The liner 21 may be applied to the tongue plate body 12 by slightly deforming the liner 21 and sliding along the tongue plate body 12 to position the channel 95 for insertion of the rear wall 15*a* of the tongue plate body 12 into the channel 95. Then, the upstanding rim 92 is inserted into the slot 15 in the tongue plate body 12 and then the nibs 96 are snapped into the holes 99 of the tongue plate body 12.

Turning now to the slidable cinch cover member 22, it may be formed with a hard plastic material in a one piece construction and may be provided with an upwardly extending protrusion 104 that prevents the slidable cinch cover member from sliding off the tongue plate body. The slidable cinch cover member is slidably mounted onto the liner 21 and onto the tongue plate body 12 with a flexing of the pull bar 22*c* and a sliding of the protrusion 104 which projects upwardly from the cinch bar 22*b* into the slot 105 in the upstanding rim 92 on the liner insert 21. This configuration assists in guiding the slide for straight travel which is also guided by the inturned side edges of the sides of the slide as will be described hereinafter.

As best seen in FIGS. 5-7, the slide protrusion 104 has a slanted or camming surface 104*a* on the upper edge thereof which cams the cinch cover member 22 away from the tongue plate body 12 when the protrusion is being installed on the tongue plate body 12. The forward vertical stop surface 104*b* at the other end of the protrusion 104 is a stop surface which will engage the metal tongue plate body 12 at the location of a notch 110 (FIG. 1) at the downward edge 111 of the slot opening 15 in the tongue plate body 12. After installation, as the slidable cover member 22 is pulled downwardly relative to the tongue plate body 12, the stop 104*b* of the protrusion 104 will move to abut the tongue plate body 12 at the notch 110 and thereby prevent the cinch cover member 22 from sliding off and separating from the tongue plate body 12. The cinch surfaces will abut to prevent the sliding of the cover member 22 off the tongue plate body 12 until a belt is installed between them.

The cinch cover member 22 is guided for sliding on the tongue plate body 12 by grooves 112 and 114 on the opposite sides of the cinch cover member. A leaf spring 116, as best seen in FIG. 1, is positioned in an opening or receiving slot 118 on one side of the tongue plate body 12 in a position to bias and provide friction so that the cinch cover member 22 does not freely move relative to the tongue plate body 12 so as to cause noise and to assist in the smooth sliding movement of the slidable cinch cover member 22 on the tongue plate body 12.

The hard and soft materials may be moldable materials. The hard material may be a plastic material such as nylon or acetyl material. The soft material may be a cushioning material such as an elastomeric, vinyl material, or rubberized material. Manifestly, other materials may be used for the anti-rattle tongue plates described herein.

While there have been illustrated and described particular embodiments of the present invention, it would be appreciated that numerous changes and modifications will occur to those skilled in the art, and it is intended in the appended claims to cover all those changes and modifications which fall within the true spirit and scope of the present invention.

What is claimed is:

1. An anti-rattle tongue plate assembly comprising:

a plate body having a wide mounting portion for mounting to a seat belt and a narrow, latching portion for being retained in a buckle;

a cover member to be mounted to the wide mounting portion of the plate body, wherein the cover member is a distinct component from the plate body and comprises a hard material; and a soft material over molded onto the cover member at predetermined locations for reducing noise due to impacts with a portion of a vehicle, wherein the cover member is formed with a locking groove on a first side of the cover member, wherein the soft material includes a projection abutting an internal surface of the locking groove and a lip engaging with an external second side of the cover member that opposes the first side, and wherein the cover member is mechanically gripped between the projection and lip.

2. The anti-rattle tongue plate assembly of claim 1, wherein the soft material is over molded on the cover member to form the projection in the locking groove for adhering and mechanically retaining the soft material on the cover member.

3. The anti-rattle tongue plate assembly of claim 1, wherein the cover member comprises a seat belt cinching surface.

4. The anti-rattle tongue plate assembly of claim 1, wherein the wide mounting portion of the plate body has a laterally expanded opening for receipt of the seat belt extending therethrough, and the cover member is configured for sliding along the wide mounting portion of the plate body for trapping the seat belt between the cover member and plate body in the laterally expanded opening.

5. The anti-rattle tongue plate assembly of claim 1, where the wide mounting portion of the plate body and the cover member cooperate to form a slot opening for receipt of the seat belt extending therethrough, wherein the cover member is configured to shift for trapping the seat belt between adjacent edges of the cover member and the wide mounting portion along the slot opening upon rapid belt travel through the slot opening.

6. The anti-rattle tongue plate assembly of claim 1, wherein the cover member comprises laterally spaced sides on either side of the wide mounting portion of the plate body, and the soft material is disposed on the laterally spaced sides.

7. The anti-rattle tongue plate assembly of claim 6, wherein the cover member comprises a narrow interconnect portion laterally extending between the laterally spaced sides across the wide mounting portion of the plate body, and the soft material is disposed on the cover member interconnect portion.

8. The anti-rattle tongue plate assembly of claim 1, wherein the cover member comprises a pull bar and a cinching surface, and wherein the pull bar is configured to shift the cinching surface upon rapid relative movement between the seat belt and plate body.

9. An anti-raffle cinch tongue plate comprising:

a plate body;

a cover member mounted to the plate body to form a slot opening for a seat belt and for shifting relative to the plate body with rapid travel of the seat belt through the slot opening for cinching the seat belt therein; and soft material mounted on the cover member to be over molded and mechanically joined to the cover member, wherein the cover member is formed with a locking groove on a first side of the cover member, wherein the soft material includes a projection abutting an internal surface of the locking groove and a lip engaging with an external second side of the cover member that opposes the first side, and wherein the cover member is mechanically gripped between the projection and lip.

10. The anti-raffle cinch tongue plate of claim 9, wherein the cover member comprises a hard material, and the soft material is over molded on the hard material.

11. The anti-rattle cinch tongue plate of claim 9, wherein the cover member and soft material have interfering portions for mechanically retaining the soft material on the cover member.

12. The anti-rattle cinch tongue plate of claim 9, wherein the plate body has a wide portion and edges on either side thereof, wherein the cover member has side portions along the edges of the wide portion and wall portions interconnecting the side portions, and the soft material is disposed on the side portions.

13. The anti-rattle cinch tongue plate of claim 12, wherein the soft material is disposed on at least one of the cover member wall portions and joined to the soft material on the side portions.

14. A method of forming an anti-rattle tongue plate assembly, the method comprising:

forming a tongue plate body;

forming a cover member that is distinct from the tongue plate body;

over molding soft material onto the cover member such that the soft material is interlocked with the cover member; and mounting the cover member including the over molded soft material to the tongue plate body, wherein the cover member is formed with a locking groove on a first side of the cover member, wherein the soft material includes a projection abutting an internal surface of the locking groove and a lip engaging with an external second side of the cover member that opposes the first side, and wherein the cover member is mechanically gripped between the projection and lip.

15. The method of claim 14, wherein the cover member is formed by molding a hard plastic material, and the soft material is connected to the cover member by placing the molded cover member in an insert mold and over molding the soft material onto the molded cover member.

16. The method of claim 14, wherein the cover member is mounted to the tongue plate body to allow the cover member to slide relative to the tongue plate body for clamping a seat belt between the cover member and tongue plate body.

17. A cinch seat belt tongue assembly for cinching a portion of a seat belt passing therethrough, comprising:

a tongue plate body having an opening for receiving a seat belt;

a cinch member slidably mounted on the tongue plate body and having an opening through which the seat belt passes, wherein outer sides on the cinch member are wrapped about the tongue plate;

a first cinching surface on the cinch member movable to a cinching position to cinch the seat belt against a second surface; and an anti-rattle material over molded on the outer sides of the cinch member to reduce noise upon impact of the tongue assembly with a vehicle, wherein the cinch member is formed with a locking groove on a first side of the cinch member, wherein the anti-rattle material includes a projection abutting an internal surface of the locking groove and a lip engaging with an external second side of the cinch member that opposes the first side, and wherein the cinch member is mechanically gripped between the projection and lip.

* * * * *